US006065860A

United States Patent [19]

Fuchsbichler

[11] Patent Number: 6,065,860

[45] Date of Patent: May 23, 2000

[54] RECIRCULATION APPARATUS AND METHOD FOR DISSOLVING PARTICULATE SOLIDS IN A LIQUID

[76] Inventor: Kevin Johan Fuchsbichler, "Mclrose" Belka South Road, Bruce Rock, Western Australia 6418, Australia

[21] Appl. No.: 09/024,334

[22] Filed: Feb. 17, 1998

Related U.S. Application Data

[63] Continuation-in-part of application No. 08/582,995, filed as application No. PCT/AU94/00422, Jul. 25, 1994, abandoned.

[30] Foreign Application Priority Data

Jul. 23, 1993 [AU] Australia ..... PM 0080

[51] Int. Cl.[7] ..... B01F 5/04; B01F 15/02

[52] U.S. Cl. ..... 366/136; 366/165.5; 366/173.2

[58] Field of Search ..... 366/136, 137, 366/165.1–165.5, 167.1, 174.1, 175.2, 173.2

[56] References Cited

U.S. PATENT DOCUMENTS

| | | | |
|---|---|---|---|
| 626,950 | 6/1899 | Wheelwright . | |
| 1,160,848 | 11/1915 | Conklin . | |
| 1,262,962 | 4/1918 | Lewis . | |
| 2,322,087 | 6/1943 | Atwood . | |
| 2,528,094 | 10/1950 | Walker . | |
| 2,906,607 | 9/1959 | Jamison . | |
| 2,997,373 | 8/1961 | Stephens . | |
| 3,208,732 | 9/1965 | Ranson . | |
| 3,212,757 | 10/1965 | Martin et al. . | |
| 3,871,272 | 3/1975 | Melandri | 366/137 |
| 3,976,109 | 8/1976 | Bailey . | |
| 4,045,004 | 8/1977 | Berger | 366/137 |
| 4,235,552 | 11/1980 | Underwood . | |
| 4,447,157 | 5/1984 | Underwood . | |
| 4,863,277 | 9/1989 | Neal et al. | 366/137 |
| 5,253,937 | 10/1993 | Scheimann et al. . | |
| 5,609,417 | 3/1997 | Otte | 366/137 |

FOREIGN PATENT DOCUMENTS

| | | |
|---|---|---|
| 27623/84 | 11/1984 | Australia . |
| 550642 | 12/1959 | Belgium . |
| 3342016 A1 | 9/1985 | Germany . |
| 4200720 A1 | 7/1993 | Germany . |
| 45-3471 | 2/1970 | Japan . |
| 1101422 | 7/1984 | U.S.S.R. . |
| 2031 748 | 4/1980 | United Kingdom . |

*Primary Examiner*—Charles E. Cooley
*Attorney, Agent, or Firm*—Allen, Dyer, Doppelt, Milbrath & Gilchrist, P.A.

[57] ABSTRACT

Particulate solids are dissolved by circulating the solids in water within a baffleless vessel. The vessel includes an upper cylindrical portion having a smooth continuous inner surface. A lower end of the cylindrical portion is formed continuously with a large diameter end of a conical frustum portion. Liquid is tapped from the small diameter end of the frustum conical portion through a suction line and pump. A part or whole of the liquid drawn off through the suction line is returned to the vessel through an inlet or diverted partially or wholly to a holding tank. The fluid returned to the vessel through the inlet is directed by a nozzle to provide substantially parallel flow to the inside surface of the vessel for creating a circular flow of liquid within the vessel. This together with the recirculation of the liquid from the outlet to the inlet of the vessel also creates a vortex flow of liquid. The circular/vortex flow holds any undissolved particles in an upper region of the cylindrical portion until they are dissolved. Thus, the circular/vortex flow is effective in dissolving the particulate solid prior to flowing through the outlet to form a solution of substantially homogeneous concentration.

6 Claims, 2 Drawing Sheets

RECIRCULATION APPARATUS AND METHOD FOR DISSOLVING PARTICULATE SOLIDS IN A LIQUID

CROSS-REFERENCE TO RELATED APPLICATIONS

This application is a continuation-in-part of application Ser. No. 08/582,995 filed on Mar. 7, 1996, now abandoned, which application was filed as national phase entry of International Application Number PCT/AU94/00422, filed Jul. 25, 1994.

FIELD OF INVENTION

The present invention relates generally to dissolving a particulate solid in a liquid for forming a solution and particularly, though not exclusively, to an apparatus and method for dissolving particulate solid materials in water for forming a solution of substantially homogeneous concentration.

BACKGROUND OF INVENTION

Chemicals including fertilizers may be purchased in either solid granular form or bulk liquid form. The bulk liquid form of the substances (liquid in large drums, by way of example) has inherent problems associated with handling and spillage which generally make the substance cumbersome and hazardous with which to work. A safer alternative to liquid substances is the use of particulate solids which can be dissolved in a liquid to form a solution. The use of particulate solids avoids the hazards associated with spillage of liquid when decanting.

When dissolving a particulate solid in a liquid, it is most advantageous to form a solution of homogenous concentration. The homogenous concentration of the solution is important where specific concentration of a liquid solution is required, by way of example, in chemical dosing for pH control in an effluent plant. Furthermore, where solids have coagulated or not otherwise dissolved, blockage may result downstream of an apparatus, for example, in spray nozzles, pumps, filters and chemical applicators such as boom sprays.

Often solids are dissolved in liquids by adding the solid to the liquid and agitating the combined solution. This agitation may be performed by mechanical stirring or bubbling air through the solution. In both instances, it is difficult to ensure that there is a consistent level of agitation throughout the solution. Consequently, the solids may settle at the bottom of a vessel without dissolving and can coagulate to form a solid or sludge which is difficult to dissolve, and/or can block downstream equipment.

A partial solution to this problem has been proposed in U.S. Pat. No. 2,997,373 to Stephens where the use of a dissolving apparatus is disclosed which comprises a vessel with a cylindrical inlet portion and a conical frustum outlet portion. A pump is in fluid communication with the outlet for recirculating liquid through the vessel. A valve is provided to tap off a portion of the recirculated liquid. The recirculated liquid is redirected into the cylindrical portion and directed to flow in a circular path along the longitudinal axis of the vessel. A number of baffle plates is provided within the vessel, for producing some turbulent action to avoid localization of solids within the liquid. Additionally, Stephens '373 discloses the use of a foraminous member between the cylindrical portion and the conical frustum portion to prevent air from being drawn down into the liquid which may interfere with the operation of the apparatus and cause foaming of the liquid. The foraminous member also acts as a sieve to prevent large undissolved particles from entering the pump.

There is a problem with the use of the baffle plates. They can be detrimental to the overall working efficiency of a system for dissolving particulate solids due to a creation of relatively static pockets of liquid behind the plates and adjacent the wall of a cylindrical portion. Any particulate solids in these pockets are unlikely to be dissolved and will fall to the bottom of the vessel. Typically in the art, such as described in the Stephens '373 patent, the particulate solids are allowed to pass through the pump to be ground by a pump impeller. Depending on the nature of the particulate solid, this can be particularly detrimental to the operation of the pump and can cause very rapid and premature wearing of the pump. It is also believed that the inclusion of the foraminous member, such as described in Stephens, can also interfere with the flow of the liquid, slowing down the speed of undissolved particulate solids in a liquid, and thereby causing them to settle to the bottom and pass through the pump undissolved.

SUMMARY OF INVENTION

In view of the foregoing background, it is therefore an object of the present invention to provide an apparatus and method for dissolving particulate solids which is of simple construction and substantially avoids the creation of turbulent flow or relatively static pockets of liquid which can cause the solid to pass undissolved through the vessel and pump.

This and other objects, features, and advantages of the invention, are provided by an apparatus for dissolving a particulate solid in a liquid for forming a solution of substantially homogenous concentration. The apparatus comprises a baffleless vessel for containing the liquid or solution. The vessel includes a substantially cylindrical portion having a smooth continuous inside surface formed continuously with a large diameter end of a conical frustum portion. The conical frustum portion includes an outlet at a small diameter end for discharge of the liquid or solution. In a preferred embodiment, the vessel has at least one inlet in fluid communication with the outlet. Further, a pump recirculates the liquid or solution through the vessel from the outlet to the inlet to effect a flow of recirculated liquid or solution through the vessel. At least one inlet of the vessel directs the recirculated liquid or solution to flow substantially parallel to an inside surface of the vessel to produce a substantially circular non turbulent flow of recirculated liquid or solution in the vessel. The circular flow is effective about a longitudinal axis of the vessel to apply forces on any undissolved particulate solid to hold the undissolved particulate solid in an upper region of the cylindrical portion until it dissolves whereby, in use, the combined action of both the pump and the inlet alone together create the substantially circular flow of the recirculated liquid or solution which is effective in dissolving the particulate solid in the liquid prior to flowing through the outlet to form a solution of substantially homogenous concentration.

Preferably, the apparatus further comprises a first valve coupled to a discharge line running from the pump to the at least one inlet for diverting a volume of the recirculated solution to a second apparatus which uses the solution, and a second value in fluid communication with each of the outlet, an upstream end of the pump, and a supply of fresh liquid. The first and second valves are moveable to respective positions by which the volume of diverted recirculated solution, set by the first valve, can be made equal to the volume of fresh liquid admitted by the second valve so that the volume of liquid or solution within the vessel remains substantially constant.

According to another aspect of the present invention there is provided a method for dissolving a particulate solid in a liquid to form a solution of substantially homogenous concentration. The method comprises the steps of providing a baffleless vessel for producing a substantially circular non turbulent flow of liquid about a longitudinal axis of the vessel. The vessel includes a cylindrical portion provided with a smooth continuous inside surface and formed continuously with a large diameter end of a conical frustum portion, the conical frustum portion includes an outlet having a small diameter end for discharge of said liquid or said solution. The method further includes the steps of pouring the liquid into the vessel, recirculating the liquid through the vessel between at least one inlet to the vessel and an outlet formed in the vessel, disposing the at least one inlet for directing the liquid parallel to an inside surface of the vessel to produce the circular flow of the liquid, and adding particulate solid to the liquid or solution while maintaining the recirculating and the circular flow to apply forces on any undissolved particulate solid to hold any undissolved particulate solid in an upper region of the cylindrical portion until it dissolves, whereby, in use, the combined action of recirculating the liquid or solution and producing the circular flow substantially fully dissolves the particulate solid prior to flowing through the output to form a solution of substantially homogenous concentration.

Preferably the method further comprises the steps of diverting a volume of the recirculated liquid to an apparatus which uses the liquid, and adding fresh liquid to the vessel at a rate substantially the same as the volume of the recirculated liquid is diverted to maintain a substantially constant level of liquid within the vessel.

BRIEF DESCRIPTION OF DRAWINGS

Preferred embodiments of the present invention will now be described, by way of example only, with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments, are provided so that disclosure will be thorough and complete, and will more fully convey the scope of the invention to those skilled in the art. Like numbers refer to like elements throughout.

Figures 1, 2, 3:
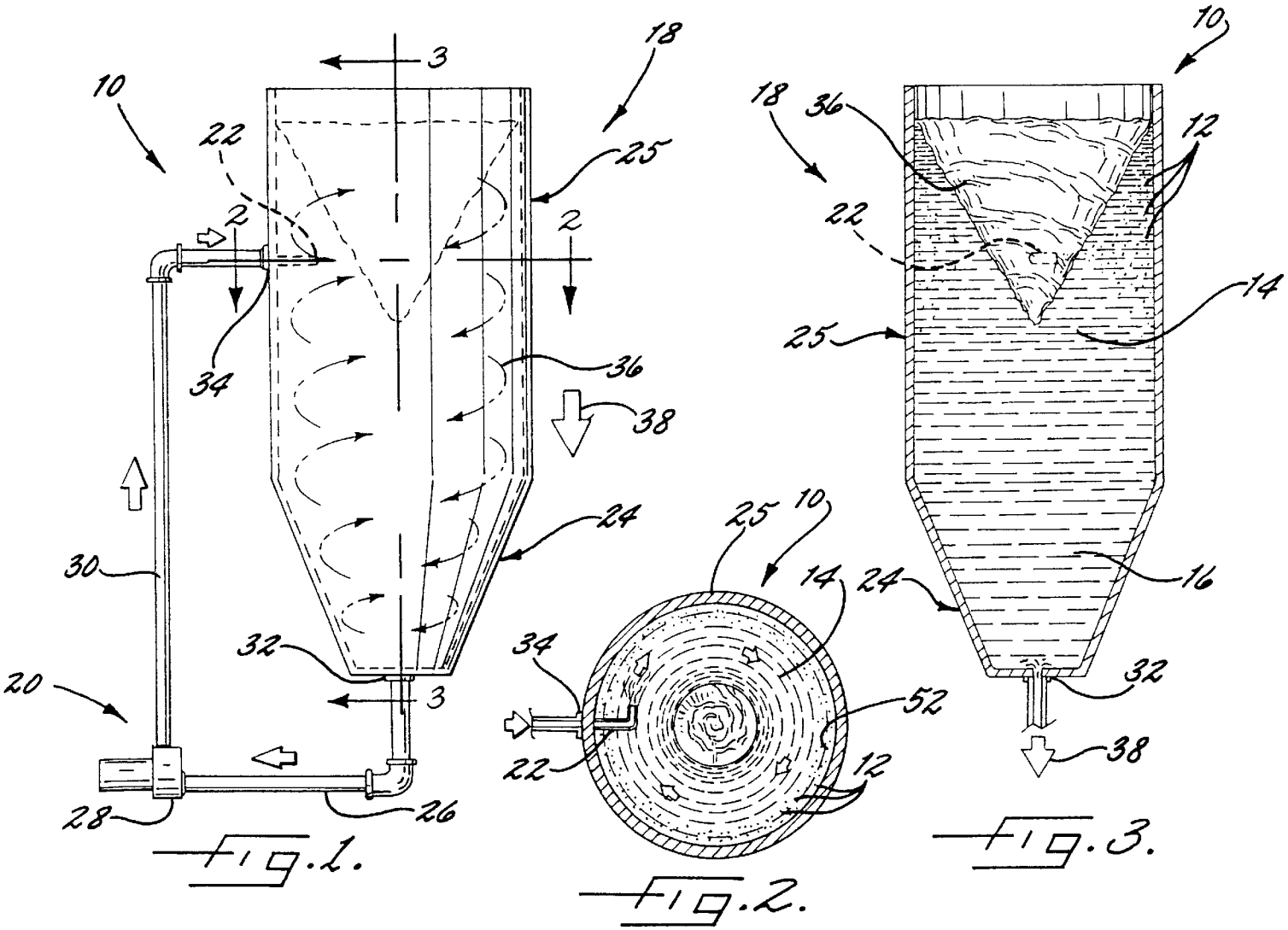
FIG. 1 is an elevation view illustrating one embodiment of the present invention for dissolving a particulate solid in a liquid.
FIG. 2 is a cross sectional view taken along line 2—2 in FIG. 1.
FIG. 3 is a partial cross-sectional view taken along line 3—3 of FIG. 1.

FIGS. 1–3 illustrate one embodiment of an apparatus 10 for dissolving a particulate solid such as granular chemical particles 12 in a liquid such as water 14 to form a liquid solution 16 of substantially homogeneous concentration. The apparatus 10 comprises a baffleless vessel 18 for containing the water 14 or the solution 16. The baffleless vessel 18 has an outlet 32 for discharge of the water 14 or solution 16 and, in the embodiment, illustrated by way of example, one inlet 34 in fluid communication with the outlet 32. Recirculating means shown generally as item 20 is provided for recirculating the water 14 or the solution 16 through the vessel 18 from the outlet 32 to the inlet 34. The recirculating means 20 includes a pump 28 for recirculating water 14 or solution 16 through the vessel 18.

In one preferred embodiment, the baffleless vessel 18 comprises a substantially cylindrical upper portion 25 having a smooth continuous inside surface. The cylindrical portion 25 is formed continuously with the largest diameter end of a conical frustum portion 24 with the smallest diameter end of the conical frustum portion 24 downstream of the largest diameter end of the conical frustum portion 24.

The recirculating means 20 further comprises a suction line 26 connected upstream of a pump 28, and a discharge line 30 plumbed downstream from the pump 28. The suction line 26 is connected to the smallest diameter end of the conical frustum 24 and the discharge line 30 is connected to the vessel 18 at the inlet 34.

The water 14 or solution 16 can be pumped from the conical frustum 24, through the outlet 32 and the suction line 26 by the pump 28 and discharged through the discharge line 30 to the inlet 34 and returned to the vessel 18 through a flow nozzle 22, as illustrated with reference again to FIGS. 1 and 2.

As illustrated with reference again to FIG. 2, the flow nozzle 22, in a preferred embodiment, comprises a tube formed in the shape of an elbow. One end of the flow nozzle 22 is connected to the baffleless vessel 18 at the inlet 34. The flow nozzle 22 is shaped to direct the water 14 or solution 16 in a direction which is substantially parallel to an inside surface of the vessel 18 adjacent the inlet 34 such that the water 14 or solution 16 is given a substantially circular non turbulent flow 36. As illustrated with reference again to FIG. 3, the circular flow 36 of the water 14 or solution 16 moves in a downstream direction 38 in the vessel 18 by action of the recirculation of water 14 or solution 16 via outlet 32, pump 28 and inlet 22 to create a vortex flow.

The vortex flow, or substantially circular non turbulent flow 36 of recirculated water 14 or solution 16, is centered about a longitudinal axis of the vessel 18. This flow applies a force on any undissolved particles 12 in the solution which results in any undissolved particles 12 being maintained in the cylindrical portion 25 until they are dissolved. It is believed that this is because the forces act on the particles 12 to cause them to move as far away as possible in the lateral direction from the longitudinal axis of the vessel. As the cylindrical portion 25 is of greater diameter than the conical frustum portion 24 (except of course for the widest part of the conical frustum portion 24) the particles 12 remain in the cylindrical portion 25. Therefore, the substantially circular non turbulent flow, the vortex flow, of the recirculated water 14 or solution 16 is effective in dissolving the particulate solid, the granular chemical particles 12 in the water 14 prior to flowing through the outlet 32 to form a solution 16 of substantially homogeneous concentration.

In an alternate embodiment of the present invention as illustrated with reference to FIG. 4, the dissolving apparatus 10 may additionally incorporate valving and plumbing for pumping the solution 16 to a holding tank 41, illustrated by way of example, and a boom spray 40 following a mixing or dissolving process. In this instance a boom spray feed line 42 is connected to the holding tank 41 of the boom spray 40 and at the opposite end is connected to the discharge line 30 at a T-piece 44. An isolating valve 46 on the boom spray feed line 42 is located between the discharge line 30 and the holding tank 41 of the boom spray 40. A recirculating valve 48 is located downstream of the T-piece 44 on the discharge line 30.

A method for dissolving the granular chemical particles 12 in the water 14 using the apparatus 10 as described above will now be described in further detail. The method is not, however, limited to this application of the apparatus 10 and is merely illustrative of the inventive concept of the present invention.

With reference again to FIG. 4, the isolating valve 46 on the boom spray feed line 42 is closed and the recirculating valve 48 on the discharge line 30 is opened. A predetermined volume of water 14 is added to the vessel 18. The predetermined volume of water 14 is such that the level of the water 14 is immediately above the flow nozzle 22 connected to the vessel 18. The pump 28 is then switched on and the water 14 is sucked in the downstream direction 38 through the vessel 18, the conical frustum 24, and along the suction line 26. The pump 28 then discharges the water 14 through the discharge line 30 and returns the water 14 to the vessel 18 at the inlet 34.

The substantially circular flow 36 is produced by the combined effect of the conical frustum portion 24 and the flow nozzle 22 which returns the water 14 to the vessel 18 in a direction substantially parallel to an inside surface of the vessel 18 adjacent the inlet 34. As earlier described, the totality of the circular flow and the recirculation of water/solution produces the vortex flow. Once this circular flow 36 has been established a predetermined mass of granular chemical 12 is added to the water 14 or the solution 16 through the open end of the vessel 18. Preferably, the granular chemical particles 12 is added to the surface of the water 14 or solution 16 in a peripheral zone 52, as illustrated with reference again to FIG. 2. Alternatively, the granular chemical particles 12 may be added through an inlet port 51, as illustrated by way of example with reference again to FIG. 4. In this way, the retention time for the granular chemical particles 12 in the water 14 or solution 16 contained in the vessel 18 is maximized thereby promoting the dissolving of the granular chemical particles 12 in the water 14 or the solution 16.

Moreover, the circular/vortex flow of water 14/solution 16 in the vessel 18 imparts forces on any undissolved particles 12 to hold them in the cylindrical portion 25 and more particularly in the upper regions thereof until they are dissolved.

Once the granular chemical particles 12 is dissolved in the water 14 or solution 16, which time will be based on the specific chemical and solution being used, the recirculating valve 48 can be closed. Trial and experiment may be necessary to determine a preferred time. A solution 16 of substantially homogenous concentration is now contained in the vessel 18. The isolating valve 46 on the boom spray feed line 42 is then opened whereupon the substantially homogeneous solution 16 is sucked by the pump 28 through the conical frustum portion 24 along the suction line 26 and discharged by the pump 28 through the discharge line 30 and the boom spray feed line 42 to the holding tank 41 of the boom spray 40. By way of example to embodiment of FIG. 4, when dissolving is complete, the pump 28 is turned off, the isolating valve 46 then closed and the recirculating valve 48 opened in preparation for mixing or dissolving another batch of granular chemical particle 12.

In a further variation, and with reference again to FIG. 4, an additional inlet 22' can be provided adjacent an inside surface of the conical frustum portion 24. The inlet 22' is in fluid communication with the discharge line 30 via a conduit 53 and valve 54 which can be selectively opened or closed. It is believed that providing an inlet 22' to the conical frustum portion 24 may further assist in the generation of the circular/vortex flow of the water 14 and solution 16. Indeed, in alternate preferred applications, it is preferable for the inlet 22' to be the only functioning inlet of flow nozzle, with inlet 22 closed off by the valve 48.

Figures 4, 5:
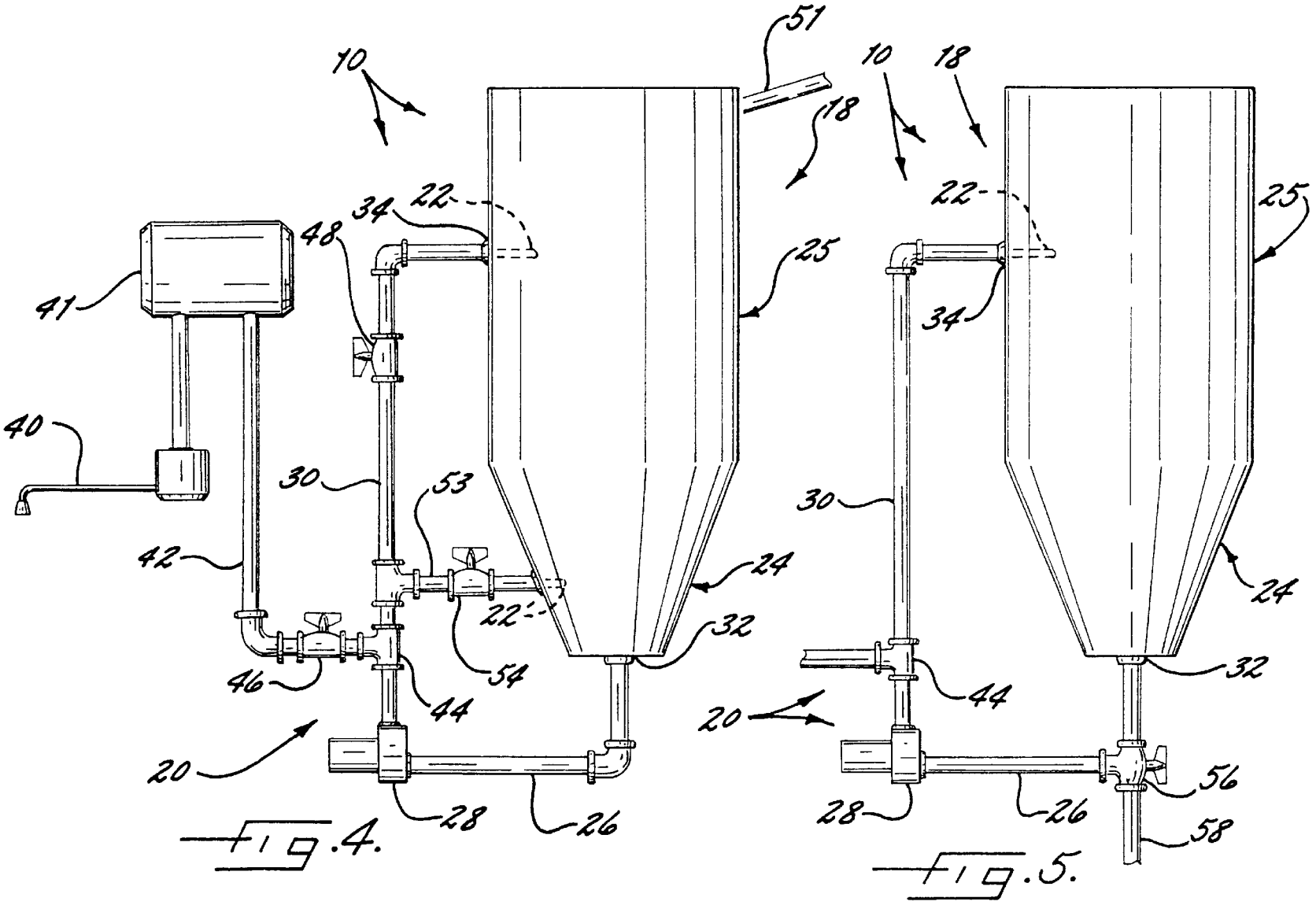
FIG. 4 is an elevation view of a second embodiment of the present invention.
FIG. 5 is an elevation view of a third embodiment of the present invention.

In yet a further variation, and with reference to FIG. 5, a three way valve 56 and water supply line 58 is inserted in the suction line 26 between the outlet 32 and pump 28. The inclusion of the three way valve 56 and water supply line 58 enables the apparatus 10 to be set up in a manner so that the rate of discharge of solution through feed line 42 and the rate of addition of fresh water through water supply line 58 and valve 56 can be made equal. This ensures that the level of water/solution within the vessel 18 remains substantially constant. In this way, the apparatus 10 can provide a continuous supply of solution as distinct from providing batch supplies. To enable the provision of continuous supplies, the granular chemical particles 12 can be added or dosed to the vessel 18 in controlled amounts using known dosing apparatus. Alternately, it can be simply manually dumped in at regular intervals.

Now that preferred embodiments of the dissolving apparatus and the method for dissolving a particulate solid in a liquid have been described in detail, it will be apparent to those skilled in the art that the apparatus and method described is able to produce the substantially homogeneous solution where essentially all of the particulate solid is dissolved prior to passing through the outlet 32, thereby dissolving provided by the present invention reducing the risk of blocking equipment downstream of the apparatus. Also, the use of moveable parts such as paddles or blade stirrers are eliminated thereby reducing maintenance and potential hazards associated with moving parts.

It will be apparent to persons skilled in the relevant arts that numerous variations and modifications can be made to the apparatus and method described in addition to those already mentioned above without departing from the basic inventive concepts of the present invention. For example, the particulate solid may be injected into the recirculating means instead of adding the solid to the vessel, as was described in the above embodiment. The pump may also be configured to fill the vessel with a predetermined volume of liquid by incorporating the necessary valves and flow lines in the dissolving apparatus. While the use of the apparatus or method is described with reference to fertigation they could equally be used in other chemical applications such as mixing or dissolving granular caustic soda in water. Further, ones proprietary or a standard anti-vortex plate may be placed at the bottom of the conical frustum portion 24 to prevent air from being sucked into line 26. All such variations and modifications are to be considered within the scope of the present invention, the nature of which is to be determined from the foregoing description and the appended claims.

That which is claimed is:

1. A method for dissolving a particulate solid in a liquid to form a solution of substantially homogenous concentration, said method comprising the steps of:

providing a baffleless vessel for producing a substantially circular non turbulent flow of liquid about a longitudinal axis of said vessel, said vessel having a cylindrical portion provided with a smooth continuous inside surface and formed continuously with a large diameter end of a conical frustum portion, said conical frustum portion having an outlet a small diameter end for discharge of said liquid or said solution;

pouring said liquid into said vessel;

recirculating the liquid through the vessel between at least one inlet to the vessel and an outlet formed in the vessel;

disposing said at least one inlet for directing said liquid parallel to an inside surface of the vessel to produce said circular flow of said liquid; and adding particulate solid to the liquid or solution while maintaining said recirculating and said circular flow to apply forces on any undissolved particulate solid to hold said any undissolved particulate solid in an upper region of the cylindrical portion until it dissolves, the combined action of recirculating said liquid or solution and producing said circular flow substantially fully dissolving the particulate solid prior to flowing through the output to form a solution of substantially homogenous concentration.

2. The method according to claim 1, further comprising the step of diverting a volume of the recirculated liquid to an apparatus which uses the liquid; and adding fresh liquid to the vessel at a rate substantially the same as the rate of diversion of the recirculated liquid to maintain a substantially constant level of liquid within the vessel.

3. The method according to claim 1, wherein the liquid recirculating step comprises the step of raising a level of the liquid above the at least one inlet.

4. An apparatus for dissolving a particulate solid in a liquid to form a solution of substantially homogenous concentration, said apparatus comprising:

a baffleless vessel for containing said liquid or said solution, said baffleless vessel comprising a substantially cylindrical portion having a smooth continuous inside surface and formed continuously with a large diameter end of a conical frustum portion, said conical frustum portion having an outlet at a small diameter end for discharge of said liquid or said solution, the vessel having at least one inlet in fluid communication with the outlet;

a pump operatively connected to said vessel for recirculating said liquid or solution through said vessel from said outlet to said at least one inlet to effect a flow of recirculated liquid or solution through the vessel;

said at least one inlet of said vessel directing the recirculated liquid or solution to flow substantially parallel to an inside surface of the vessel to produce a substantially circular non turbulent flow of recirculated liquid or solution in the vessel, said circular flow being effective about a longitudinal axis of the vessel to apply forces on any undissolved particulate solid to hold the undissolved particulate solid in an upper region of the cylindrical portion until it dissolves whereby, in use, the combined action of both said pump and said at least one inlet alone together create the substantially circular flow of said recirculated liquid or solution which is effective in dissolving said particulate solid in said liquid prior to flowing through the outlet to form a solution of substantially homogenous concentration; a first valve coupled to a discharge line running from the pump to the at least one inlet for diverting a volume of the recirculated solution to a second apparatus which uses the solution; and a three way valve in fluid communication with said outlet, a suction side of the pump, and a supply of fresh liquid, the first valve and three way valve moveable to respective positions by which the volume of diverted recirculated solution set by the first valve can be made equal to the volume of fresh liquid admitted by the three way valve so that the volume of liquid or solution within the vessel remains substantially constant.

5. The apparatus according to claim 4, wherein said at least one inlet of said vessel is positioned below a level of said liquid or said solution during operation of said apparatus for dissolving the particulate solid therein.

6. A method for dissolving a particulate solid in a liquid to form a solution of substantially homogenous concentration, said method comprising the steps of:

providing a baffleless vessel for producing a substantially circular non turbulent flow of liquid about a longitudinal axis of said vessel, said vessel having a cylindrical portion provided with a smooth continuous inside surface and formed continuously with a large diameter end of a conical frustum portion, said conical frustum portion having an outlet a small diameter end for discharge of said liquid or said solution;

pouring said liquid into said vessel;

recirculating the liquid through the vessel between at least one inlet to the vessel and an outlet formed in the vessel;

disposing said at least one inlet for directing said liquid parallel to an inside surface of the vessel to produce said circular flow of said liquid; and adding particulate solid to the liquid or solution while maintaining said recirculating and said circular flow to apply forces on any undissolved particulate solid to hold said any undissolved particulate solid in an upper region of the cylindrical portion until it dissolves, the combined action of recirculating said liquid or solution and producing said circular flow substantially fully dissolving the particulate solid prior to flowing through the output to form a solution of substantially homogenous concentration; and diverting a volume of the recirculated liquid to an apparatus which uses the liquid; and adding fresh liquid to the vessel at a rate substantially the same as the rate of diverting the recirculated liquid to maintain a substantially constant level of liquid within the vessel.

* * * * *